US010328586B2

(12) United States Patent
Chen et al.

(10) Patent No.: US 10,328,586 B2
(45) Date of Patent: Jun. 25, 2019

(54) MULTIFUNCTIONAL ELECTRIC GROOMER

(71) Applicant: ZHEJIANG JINDA MOTORS AND ELECTRIC APPLIANCES CO., LTD., Zhoushan, Zhejiang (CN)

(72) Inventors: Huilong Chen, Zhoushan (CN); Xingyuan Tian, Zhoushan (CN); Zhenjian Feng, Zhoushan (CN)

(73) Assignee: ZHEJIANG JINDA MOTORS AND ELECTRIC APPLIANCES CO., LTD., Zhoushan, Zhejiang (CN)

( * ) Notice: Subject to any disclaimer, the term of this patent is extended or adjusted under 35 U.S.C. 154(b) by 64 days.

(21) Appl. No.: 15/551,030

(22) PCT Filed: Oct. 18, 2016

(86) PCT No.: PCT/CN2016/102304

§ 371 (c)(1),
(2) Date: Aug. 14, 2017

(87) PCT Pub. No.: WO2018/058710

PCT Pub. Date: Apr. 5, 2018

(65) Prior Publication Data

US 2018/0281212 A1 Oct. 4, 2018

(30) Foreign Application Priority Data

Sep. 29, 2016 (CN) ..... 2016 1 0860902

(51) Int. Cl.

| | |
|---|---|
| ***B26B 19/26*** | (2006.01) |
| ***B26B 19/10*** | (2006.01) |
| ***B26B 19/38*** | (2006.01) |

(52) U.S. Cl.
CPC ..... *B26B 19/265* (2013.01); *B26B 19/105* (2013.01); *B26B 19/26* (2013.01); *B26B 19/382* (2013.01)

(58) Field of Classification Search
CPC ..... B26B 19/265; B26B 19/105; B26B 19/26; B26B 19/382; G01L 3/1435
See application file for complete search history.

(56) References Cited

U.S. PATENT DOCUMENTS

| | | | | |
|---|---|---|---|---|
| 5,206,994 A * | 5/1993 | Lin | B26B 21/24 30/47 |
| 7,093,363 B1 * | 8/2006 | Kuo | B26B 21/40 30/32 |
| 2011/0252646 A1 * | 10/2011 | Gordon | B26B 21/225 30/47 |

FOREIGN PATENT DOCUMENTS

| | | |
|---|---|---|
| CN | 201931478 U | 8/2011 |
| CN | 204136075 U | 2/2015 |

(Continued)

*Primary Examiner* — Omar Flores Sanchez
(74) *Attorney, Agent, or Firm* — Christensen, Fonder, Dardi & Herbert PLLC

(57) ABSTRACT

A multifunctional electric groomer including a casing in which a driving module is provided, at least two blade sets, each of which is equipped with a support, one end of the support fixing the blade set and the other end of the support being hinged on the casing, with the hinge points of the supports successively arranged along the direction of the output shaft of the driving module. Each of the blade sets has a housed position and an operating position to dynamically couple with the driving module. A clutch coupling is provided between the output shaft of the driving module and the input shaft of the blade set.

19 Claims, 15 Drawing Sheets

(56) References Cited

FOREIGN PATENT DOCUMENTS

| | | | |
|---|---|---|---|
| CN | 104493848 | A | 4/2015 |
| CN | 204487618 | U | 7/2015 |
| CN | 105034030 | A | 11/2015 |
| CN | 206085108 | U | 4/2017 |
| CN | 206123716 | U | 4/2017 |
| WO | WO 2007/130680 | A1 | 11/2007 |

* cited by examiner

MULTIFUNCTIONAL ELECTRIC GROOMER

RELATED APPLICATIONS

The present application is a National Phase entry of PCT Application No. PCT/CN2016/102304, filed Oct. 18, 2016, which claims priority to Chinese Patent Application No. 201610860902.1, filed Sep. 29, 2016, the disclosures of which are hereby incorporated by reference herein in their entirety.

TECHNICAL FIELD

The present invention relates to the field of personal care products, particularly to a multifunctional electric groomer.

BACKGROUND

Known trimmers tend to have a small and exquisite design, and there are a wide range of single-functioned products with advantages of good appearance and stable performance. Trimming tools include hair clippers, shavers, nose hair trimmers, eyebrow shavers and the like, and for consumers, a full set of these tools would cost a lot and is not easy to maintain and store. Therefore, electric groomers with multiple functions have emerged in the market, all of which have defects or shortages though.

The granted patent CN201931478U discloses a multifunctional electric hair cutting device, which may be connected with a hair clipper tool bit, a shaver tool bit, a brow and nose hair trimmer tool bit, a massager bit, a round nose hair trimmer bit, a tooth polisher bit, a nail polisher bit and the like. The tool bits in this invention are independent components that need to be connected to the device before use, and the downside of the invention lies in that the assembly process before use is troublesome whereas the unused tool bits are easy to lose.

The patent application CN104493848A discloses an integral shaving and haircutting device wherein shifting between the shaving function and the haircutting function is realized by rotating an execution element. In this invention, a shaver set and a hair cutter set are respectively driven by two output shafts of a double-shaft motor, and the feature of the double-shaft motor determines that the invention has a maximum of two functions and is unable to achieve more hair trimming functions.

SUMMARY

In order to overcome the above defects in those known multifunctional electric groomers, the present invention provides a multifunctional electric groomer with a function of switching between blade sets.

The present invention employs a technical solution as follows:

A multifunctional electric groomer comprises a casing in which a driving module is provided, and further comprises at least two blade sets, each of which is equipped with a support, one end of the support fixing the blade set and the other end of the support being hinged on the casing, with the hinge points of the supports successively arranged along the direction of the output shaft of the driving module; and each of the blade sets has an operating position when turned to dynamically couple with the driving module and a housed position when turned to be housed inside the casing, and a clutch coupling is provided between the output shaft of the driving module and the input shaft of the blade set.

The blade sets comprise a nose hair trimmer blade set, a hair clipper blade set and a shaver blade set, and a first support, a second support and a third support are provided in correspondence with them respectively; and the blade sets have a housed station where the nose hair trimmer blade set, the hair clipper blade set and the shaver blade set are all in their housed positions, a nose hair trimmer station where the nose hair trimmer blade set is in the operating position whereas the hair clipper blade set and the shaver blade set are in their housed positions, a hair clipper station where the hair clipper blade set is in the operating position whereas the nose hair trimmer blade set and the shaver blade set are in their housed positions, and a shaver station where the shaver blade set is in the operating position whereas the nose hair trimmer blade set and the hair clipper blade set are in their housed positions.

The end parts of the input shafts of the nose hair trimmer blade set, the hair clipper blade set and the shaver blade set respectively follow semicircle turning tracks of a first track, a second track and a third track with a corresponding radius of R1, R2 and R3; and the first track, the second track, and the third track are tangent to each other at the end part of the output shaft of the driving module, with $R1<R2<R3$.

The first support, the second support, and the third support are two-armed supports which constitute door-like frames respectively with the nose hair trimmer blade set, the hair clipper blade set and the shaver blade set, and are hinged on the two sides of the casing.

The hinge points of the first support, the second support, and the third support are arranged successively from the front to the end of the output shaft of the driving module, and the distances between the two arms of the first support, the second support, and the third support get larger in sequence.

A pile head is provided at the clearance between the driving module and the casing, and the first support, the second support, and the third support are hinged on the driving module, the pile head, and the casing respectively.

The casing is a case shaped like half of a box, the driving module is positioned at the front half of the casing and has an output shaft facing outwards, and the rear half of the casing functions as a housing chamber of the blade sets.

A receiving chamber for receiving the driving module is provided at the front half of the casing, and the casing and the receiving chamber are integrally formed.

A flip cover is hinged on the casing. The flip cover has, when flipped open, a first position allowing switchover of the blade sets, and has, when closed, a second position for operation or storage.

A notch is provided on the flip cover to expose a switch button of the driving module.

The clutch coupling is a magnetic coupling comprising an active pole mounted on the output shaft of the driving module and passive poles on the input shafts of the blade sets.

The magnetic coupling is a planar synchronous transmission, and magnets with their north poles and south poles alternately arranged are provided on the opposite disk planes of the active pole and the passive poles.

An isolation layer that isolates the active pole from outside is provided on the casing.

The clutch coupling comprises a triangle output head mounted on the output shaft of the driving module, and concave connection heads mounted on the input shafts of the blade sets; and the triangle output head is retractable, and has, when compressed, a first position allowing switchover of the blade sets and has, when protruding into the concave connection heads, a second position for power transmission.

The concave connection head is provided with a Y-shaped slot to fit with the triangle output head, each of the three straight slots of the Y-shaped slot being provided with an inclined plane at the same side.

The present invention has the following beneficial effects:

Each of the blade sets in the present invention has an operating position and a housed position, and if a user wants to use a certain blade set, all he needs to do is to turn it into the operating position and then such blade set can perform its hair trimming function using the clutch coupling for power transmission. Since all the blade sets are mounted on the casing, the switchover of different blade sets would be quick and easy as requiring no additional assembly process, and loss of components is avoided.

Figure 1:
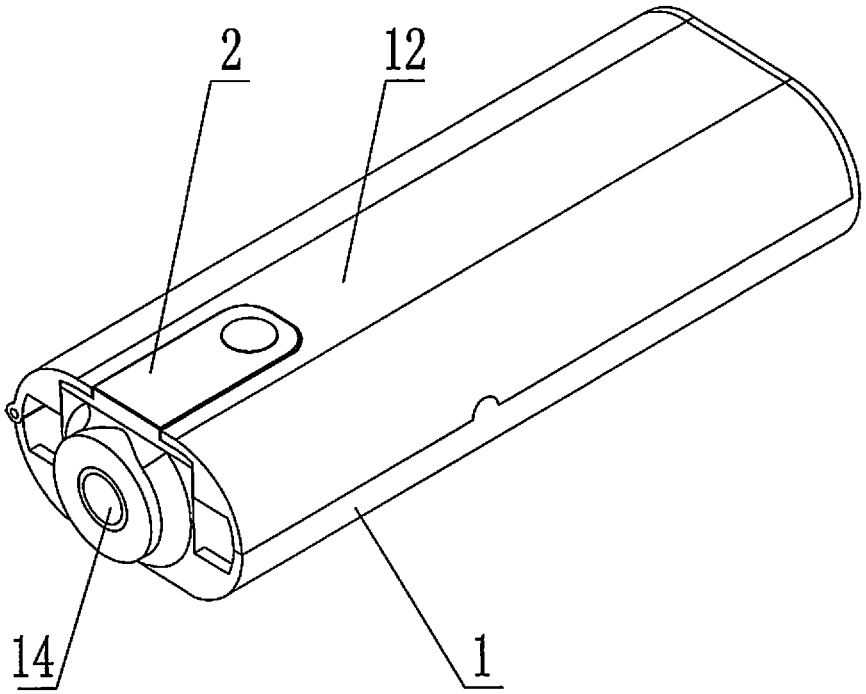
FIG. 1 is a schematic external view of a first embodiment of the present invention.

Housing 1; Driving module 2; Nose hair trimmer blade set 3; Hair clipper blade set 4; Shaver blade set 5; First support 6; Second support 7; Third support 8; Pile head 9; Housing chamber 10; Receiving chamber 11; Flip cover 12; Notch 13; Active pole 14; Passive pole 15; Isolation layer 16; Triangle output head 17; Concave connection head 18; Inclined plane 19; First track L1; Second track L2; Third track L3.

DETAILED DESCRIPTION

Here is a detailed description with reference to the drawings and the embodiments of a groomer having the three functions of a nose hair trimmer, a hair clipper and a shaver.

Figure 2:
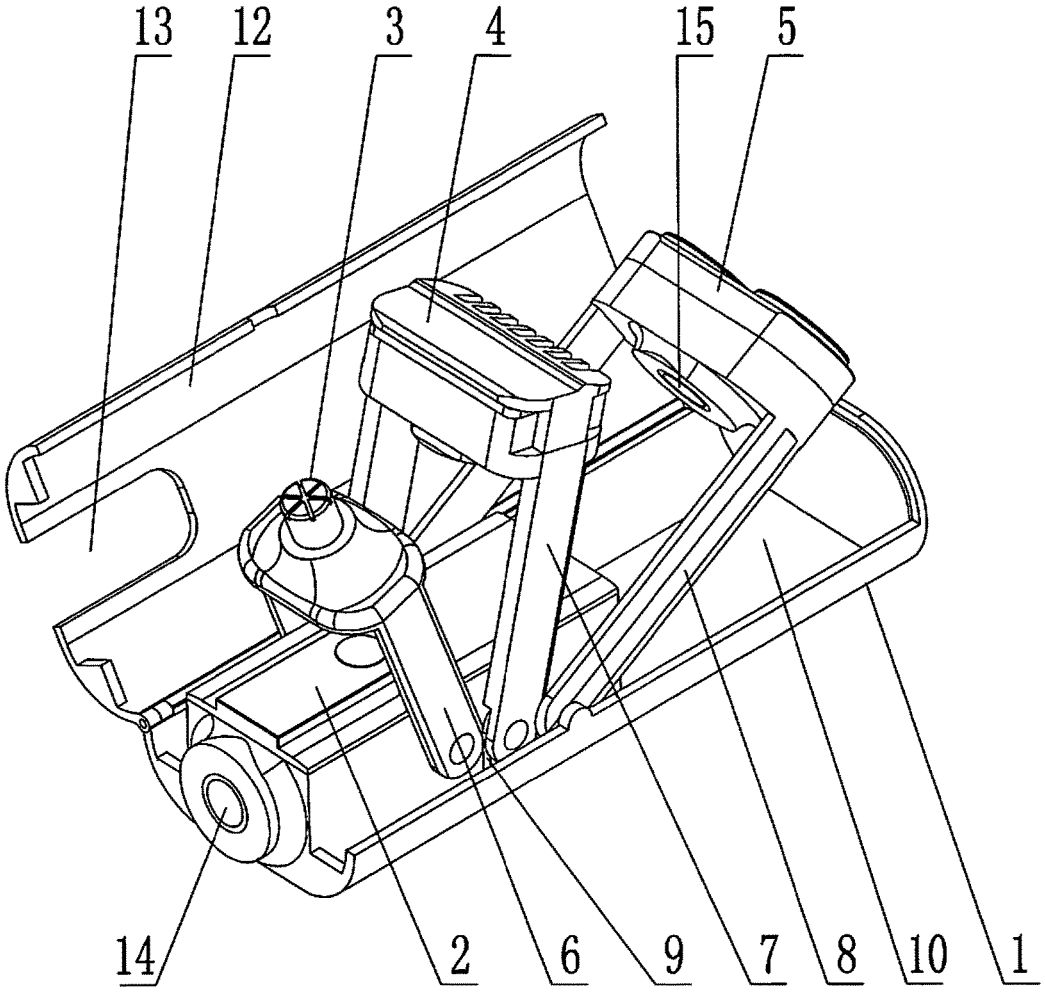
FIG. 2 is a schematic structural view of the first embodiment of the present invention.
Figure 3:
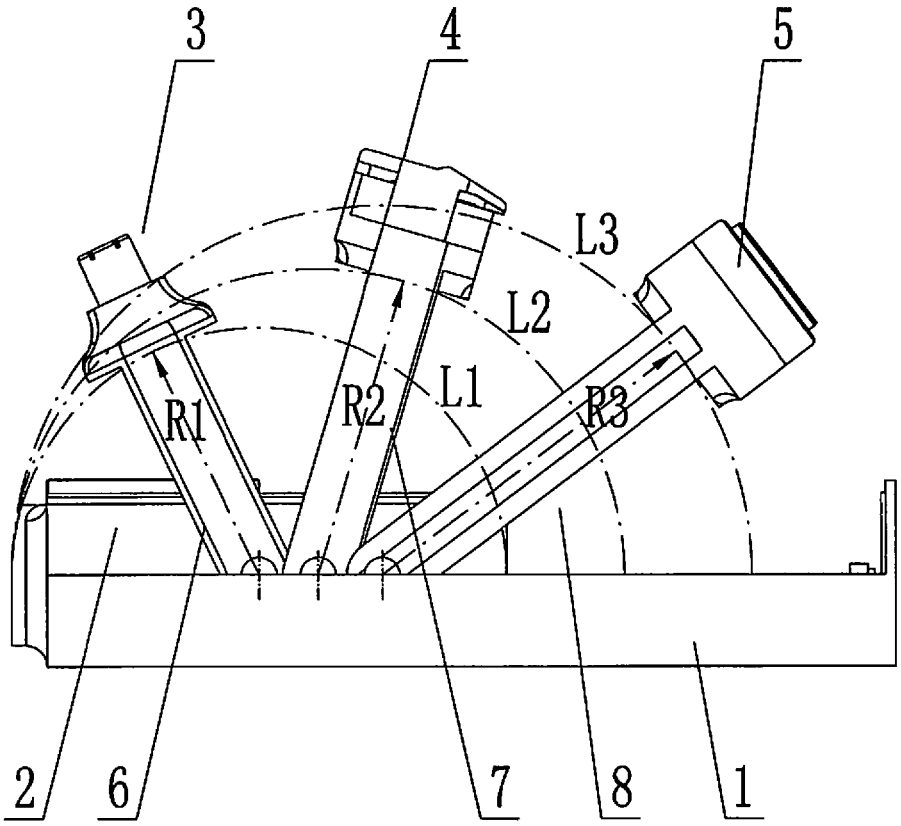
FIG. 3 is a schematic illustration of turning tracks of blade sets in the first embodiment of the present invention.
Figure 4:
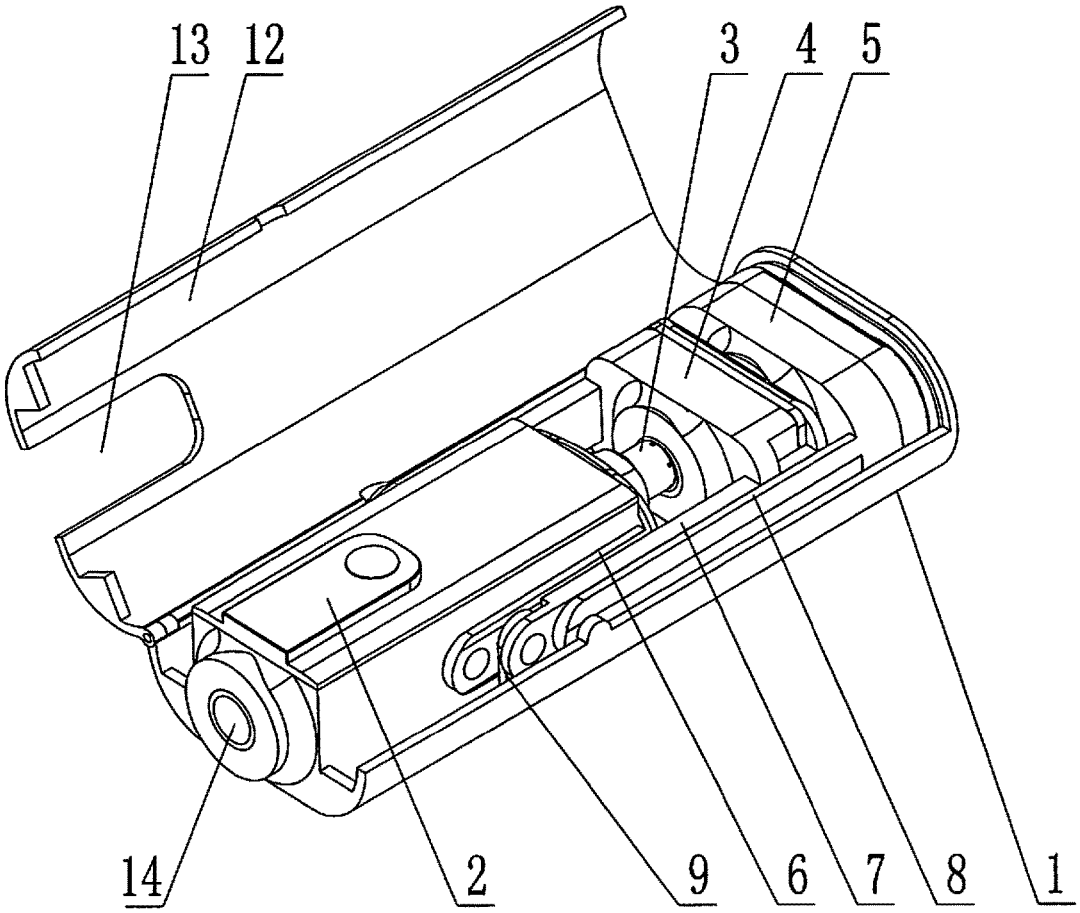
FIG. 4 is a schematic illustration of a housed station in the first embodiment of the present invention.
Figure 5:
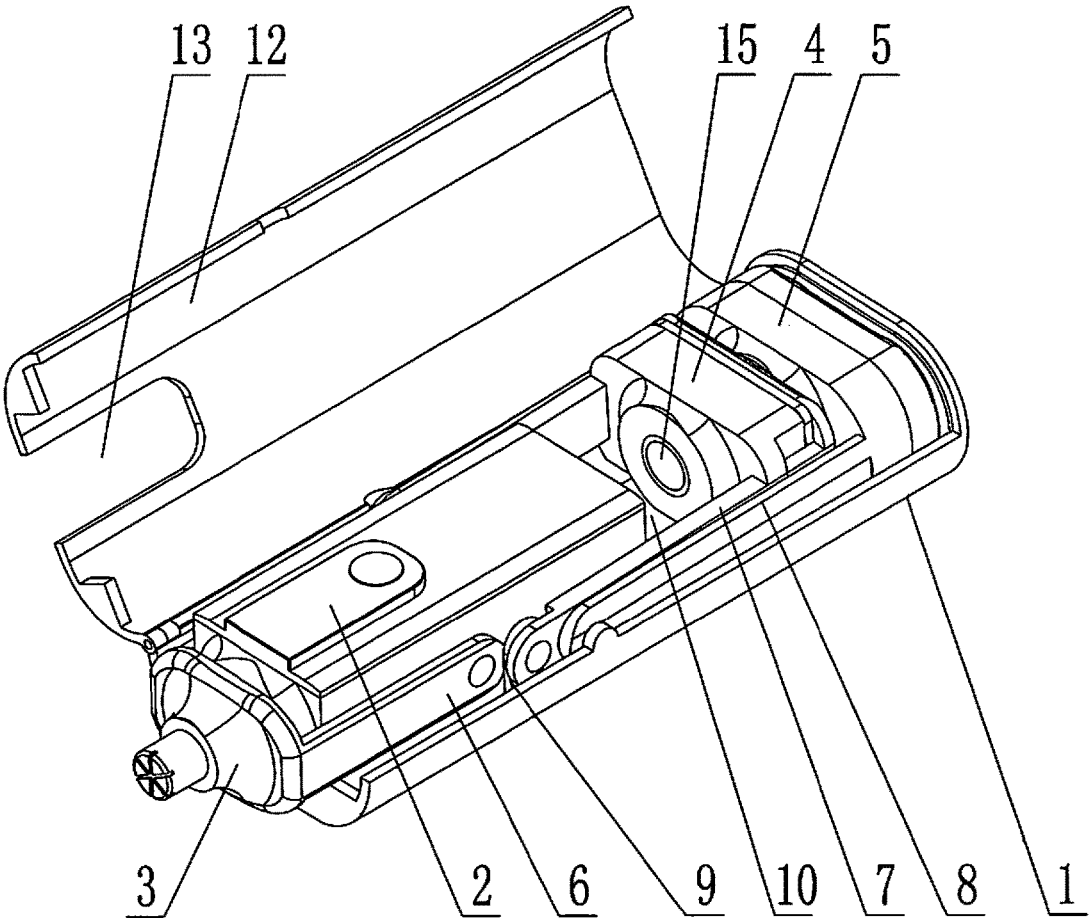
FIG. 5 is a schematic illustration of a nose hair trimmer station in the first embodiment of the present invention.
Figure 6:
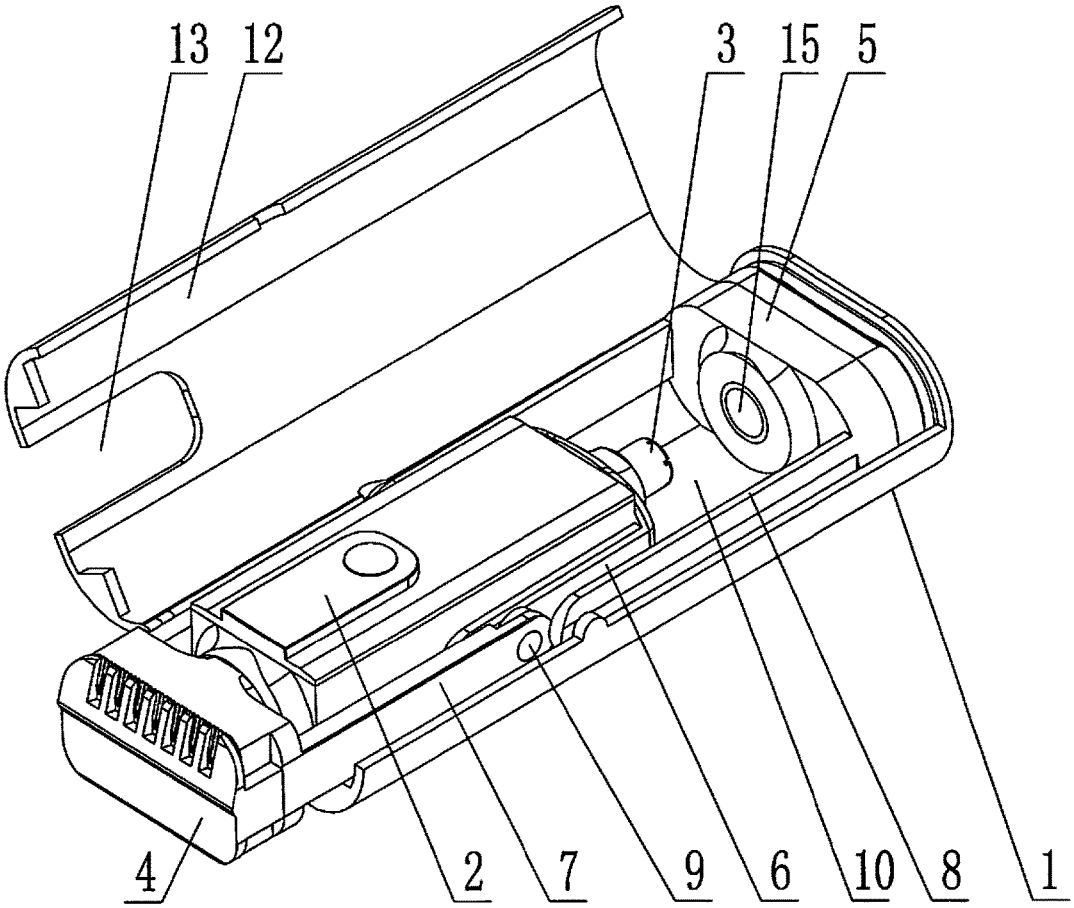
FIG. 6 is a schematic illustration of a hair clipper station in the first embodiment of the present invention.
Figure 7:
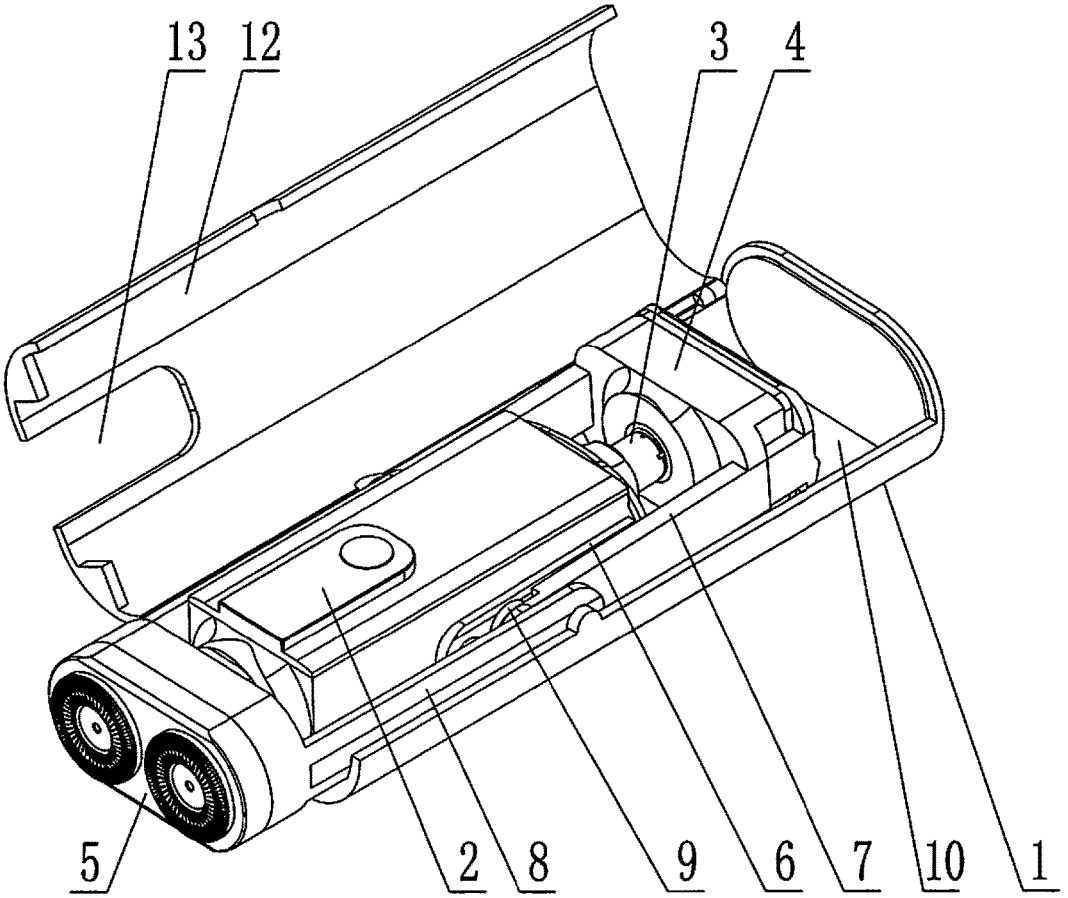
FIG. 7 is a schematic illustration of a shaver station in the first embodiment of the present invention.

In the first embodiment, as shown in FIG. 1, FIG. 2 and FIG. 3, a multifunctional electric groomer comprises a casing 1 in which a driving module 2 is provided, and further comprises at least two blade sets, each of which is equipped with a support, one end of the support fixing the blade set and the other end of the support being hinged on the casing 1, with the hinge points of the supports successively arranged along the direction of the output shaft of the driving module 2. Each of the blade sets has an operating position when turned to dynamically couple with the driving module 2 and a housed position when turned to be housed inside the casing 1, a clutch coupling is provided between the output shaft of the driving module 2 and the input shaft of the blade set, and the driving module 2 contains power supply, motor, circuit board, switch and other components. Each of the blade sets in the first embodiment has an operating position and a housed position, and if a user wants to use a certain blade set, all he needs to do is to turn it into the operating position and then such blade set can perform its hair trimming function using the clutch coupling for power transmission. Since all the blade sets are mounted on the casing 1, switching between different blade sets would be quick and easy as requiring no additional assembly process, and loss of components is avoided.

In the first embodiment, as shown in FIG. 2, FIG. 3, FIG. 4, FIG. 5, FIG. 6, and FIG. 7, the blade sets comprise a nose hair trimmer blade set 3, a hair clipper blade set 4 and a shaver blade set 5, and a first support 6, a second support 7 and a third support 8 are provided in correspondence with them respectively. The blade sets have a housed station where the nose hair trimmer blade set 3, the hair clipper blade set and the shaver blade set 5 are all in their housed positions, a nose hair trimmer station where the nose hair trimmer blade set 3 is in the operating position whereas the hair clipper blade set 4 and the shaver blade set 5 are in their housed positions, a hair clipper station where the hair clipper blade set 4 is in the operating position whereas the nose hair trimmer blade set 3 and the shaver blade set 5 are in their housed positions, and a shaver station where the shaver blade set 5 is in the operating position whereas the nose hair trimmer blade set 3 and the hair clipper blade set 4 are in their housed positions. The structure of the first embodiment realizes a three-in-one function of a nose hair trimmer, a hair clipper and a shaver, and the present invention may combine more different blade sets according to users' requirements to obtain a groomer with more functions.

In the first embodiment, as shown in FIG. 2, FIG. 3, FIG. 4, FIG. 5, FIG. 6, and FIG. 7, the end parts of the input shafts of the nose hair trimmer blade set 3, the hair clipper blade set 4 and the shaver blade set 5 respectively follow semicircle turning tracks of a first track L1, a second track L2 and a third track L3 with a corresponding radius of R1, R2 and R3; and the first track L1, the second track L2, and the third track L3 are tangent to each other at the end part of the output shaft of the driving module 2, with $R1<R2<R3$. L1, L2 and L3 in the first embodiment are positioned in such relationship so that the nose hair trimmer blade set 3, the hair clipper blade set 4 and the shaver blade set 5 would not interfere with each other when being turned and could achieve dynamic coupling with the same driving module 2.

Figure 9:
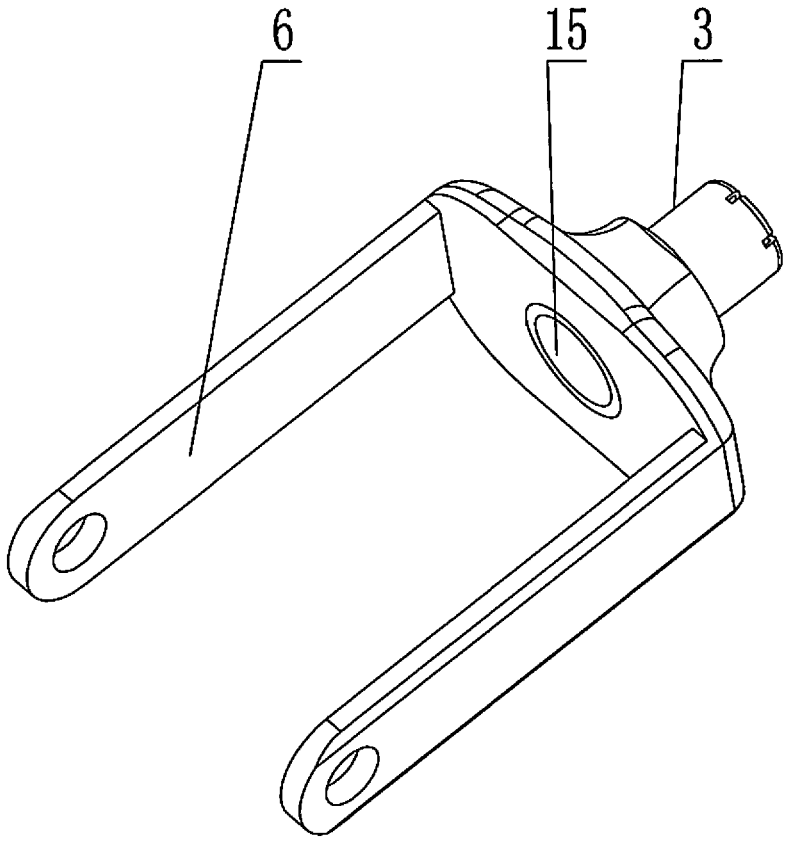
FIG. 9 is a schematic illustration of a nose hair trimmer blade set in the first embodiment of the present invention.
Figure 10:
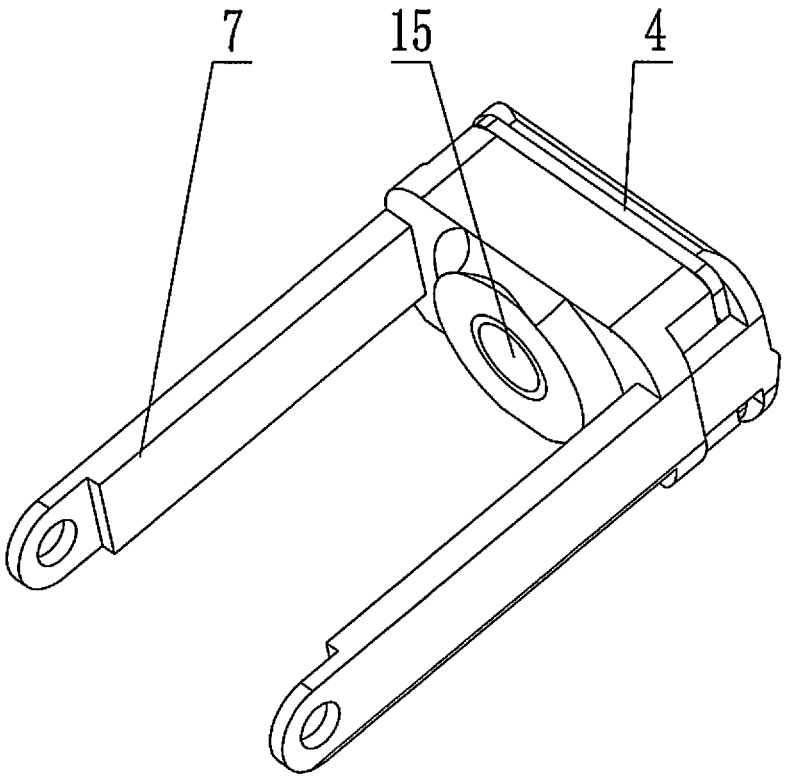
FIG. 10 is a schematic illustration of a hair clipper blade set in the first embodiment of the present invention.
Figure 11:
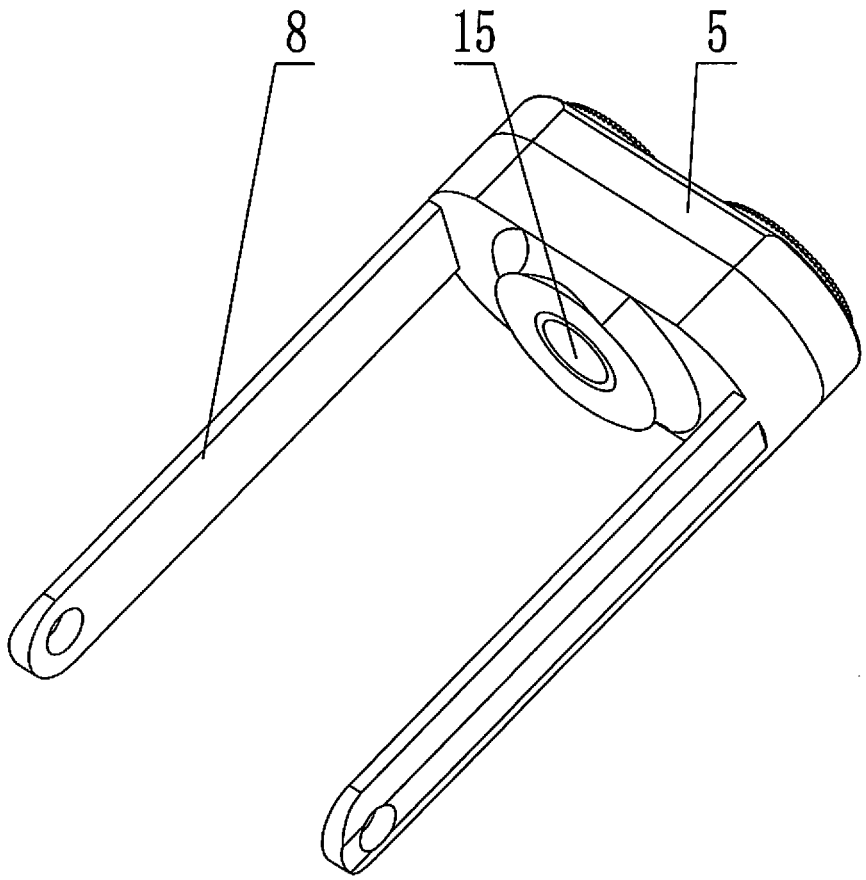
FIG. 11 is a schematic illustration of a shaver blade set in the first embodiment of the present invention.

In the first embodiment, as shown in FIG. 9, FIG. 10, and FIG. 11, the first support 6, the second support 7, and the third support 8 are two-armed supports which constitute door-like frames respectively with the nose hair trimmer blade set 3, the hair clipper blade set 4 and the shaver blade set 5, and are hinged on the two sides of the casing 1. The two-armed supports are preferred in the first embodiment with advantages of solid installation and good stability.

In the first embodiment, as shown in FIG. 2, FIG. 3, FIG. 4, FIG. 5, FIG. 6, and FIG. 7, the hinge points of the first support 6, the second support 7, and the third support 8 are arranged successively from the front to the end of the output shaft of the driving module 2, and the distances between the two arms of the first support 6, the second support 7, and the third support 8 get larger in sequence. In the first embodiment, the distances between the two arms of the first support 6, the second support 7, and the third support 8 are provided as getting larger in sequence so that the first support 6, the second support 7, and the third support 8 in the housed station can overlap successively without interfering with each other to minimize the space occupied.

In the first embodiment, as shown in FIG. 4, FIG. 5, FIG. 6, FIG. 7, and FIG. 8, a pile head 9 is provided at the clearance between the driving module 2 and the casing 1, and the first support 6, the second support 7, and the third support 8 are hinged on the driving module 2, the pile head 9, and the casing 1 respectively. The structure of the first embodiment ensures that the first support 6, the second support 7, and the third support 8 are hinged at different positions in the axial and width directions so as not to interfere with each other when turned.

Figure 8:
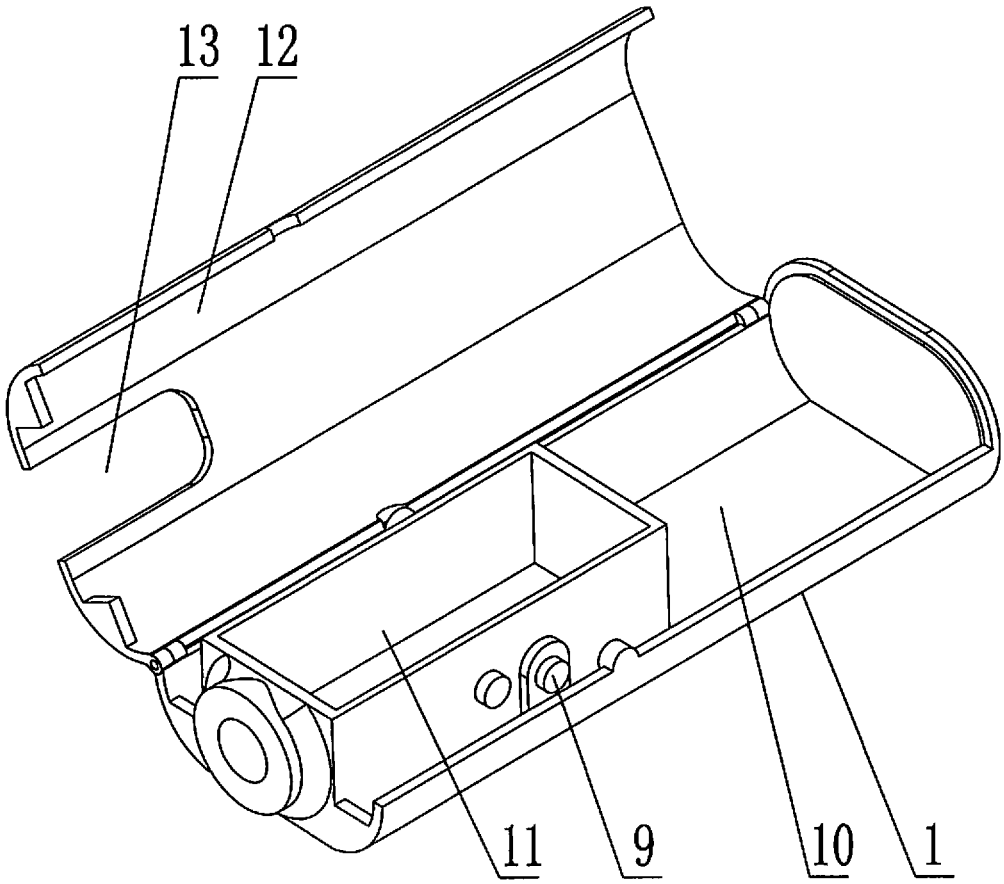
FIG. 8 is a schematic illustration of a casing in the first embodiment of the present invention.

In the first embodiment, as shown in FIG. 2 and FIG. 8, the casing 1 is a case shaped like half of a box, the driving module 2 is positioned at the front half of the casing 1 and has an output shaft facing outwards, and the rear half of the casing 1 functions as a housing chamber 10 of the blade sets. Dividing the casing 1 of the first embodiment into two parts ensures the basically same appearance of the groomer in whichever stations, and makes it convenient to place and store.

In the first embodiment, as shown in FIG. 8, a receiving chamber 11 for receiving the driving module 2 is provided at the front half of the casing 1, and the casing 1 and the receiving chamber 11 are integrally formed. The structure of the casing 1 of the first embodiment is easy to manufacture and the driving module 2 can be installed securely not to move easily.

In the first embodiment, as shown in FIG. 4, FIG. 5, FIG. 6, FIG. 7, and FIG. 8, a flip cover 12 is hinged on the casing 1. The flip cover 12 has, when flipped open, a first position allowing switchover of the blade sets, and has, when closed, a second position for operation or storage. The first embodiment uses the movable flip cover 12 for easy switchover and protection of the blade sets.

In the first embodiment, as shown in FIG. 4, FIG. 5, FIG. 6, FIG. 7, and FIG. 8, a notch 13 is provided on the flip cover 12 to expose a switch button of the driving module 2. Although the switch button of the driving module 2 is provided on the side of the flip cover 12 in the first embodiment, it may also be provided elsewhere as appropriate.

Figure 12:
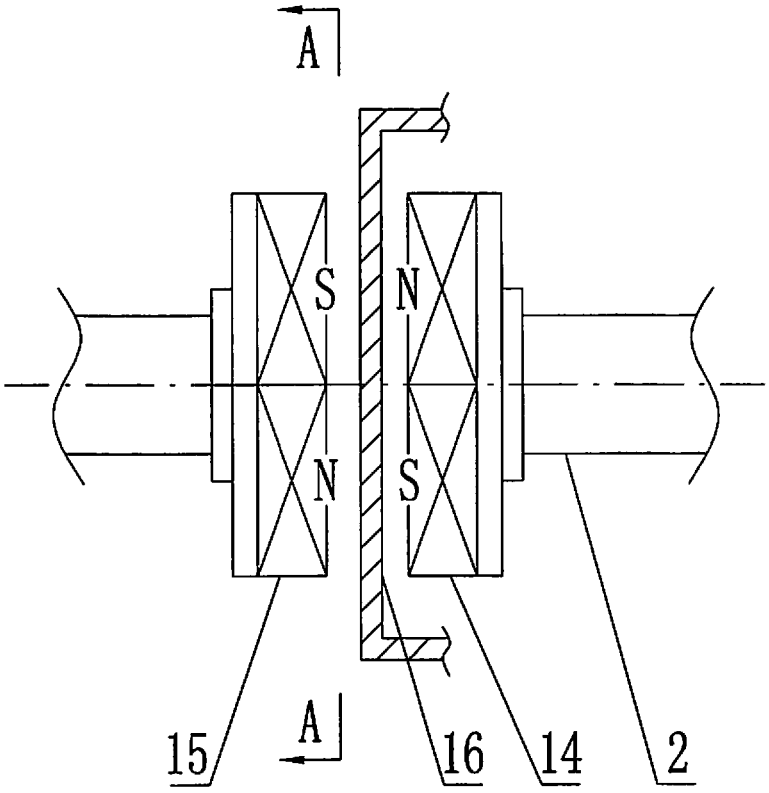
FIG. 12 is a schematic illustration of a magnetic coupling in the first embodiment of the present invention.

In the first embodiment, as shown in FIG. 2 and FIG. 12, the clutch coupling is a magnetic coupling comprising an active pole 14 mounted on the output shaft of the driving module 2 and passive poles 15 on the input shafts of the blade sets. The first embodiment uses, as the clutch coupling, a magnetic coupling with obvious advantages over conventional rigid or elastic couplings in coupling performance.

Figure 13:
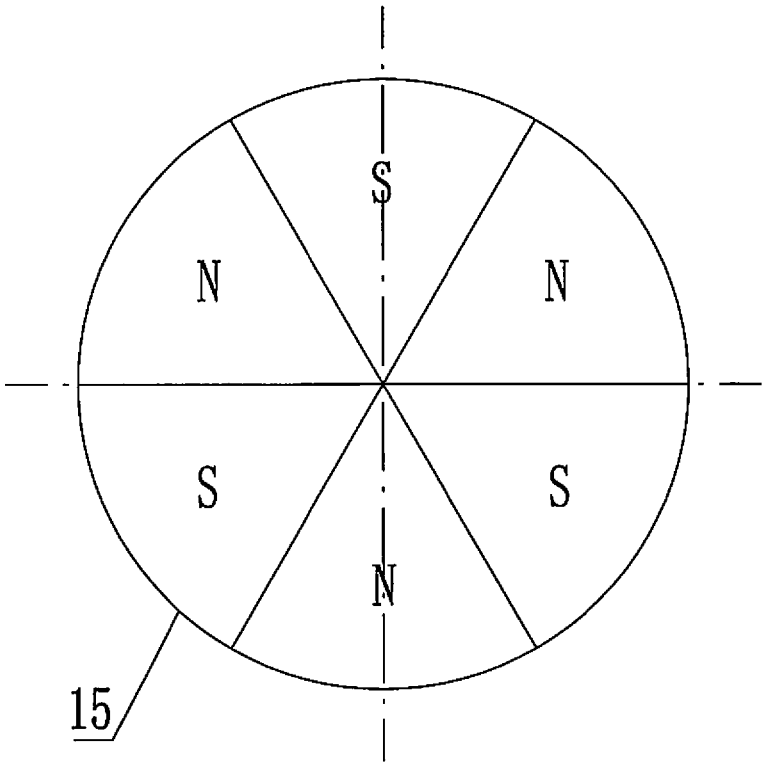
FIG. 13 is a schematic illustration of the first embodiment of the present invention at A-A.

In the first embodiment, as shown in FIG. 13, the magnetic coupling is a planar synchronous transmission, and magnets with their north poles and south poles alternately arranged are provided on the opposite disk planes of the active pole 14 and the passive poles 15. Although six magnets are arranged alternately in the first embodiment, the present invention may also deploy magnets in any other quantities to constitute the active pole 14 and the passive poles 15 according to the actual situation; and besides, coupling is more convenient with a planar synchronous transmission than other magnet couplings like a coaxial transmission.

In the first embodiment, as shown in FIG. 12, an isolation layer 16 that isolates the active pole 14 from outside is provided on the casing 1. The active pole 14 being provided with the isolation layer 16 in the first embodiment achieves complete isolation of the driving module 2 from outside for better showerproof.

Figure 14:
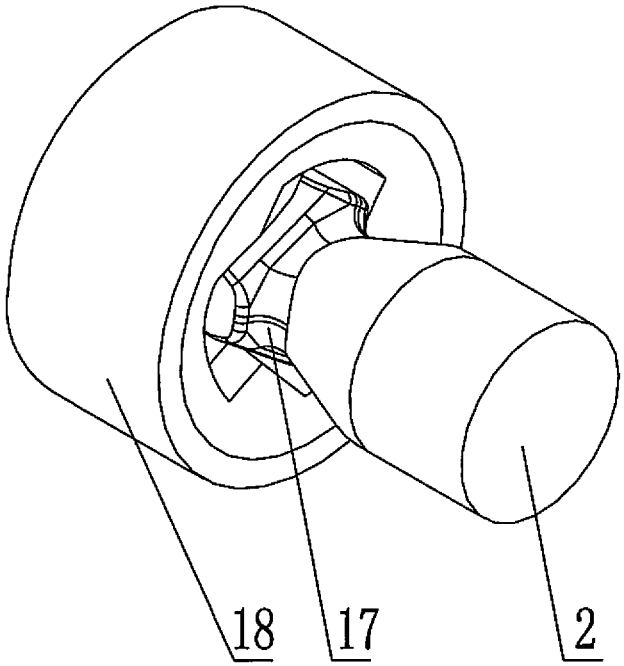
FIG. 14 is a schematic illustration of a clutch coupling in the second embodiment of the present invention.

In the second embodiment, as shown in FIG. 14, the clutch coupling comprises a triangle output head 17 mounted on the output shaft of the driving module 2, and concave connection heads 18 mounted on the input shafts of the blade sets; the triangle output head 17 is retractable, and has, when compressed, a first position allowing switchover of the blade sets and has, when protruding into the concave connection heads 18, a second position for power transmission. The triangle output head 17 of the second embodiment is able to change its position by means of an elastic member or a position button, and in comparison with the magnetic coupling of the first embodiment, although its coupling process is slightly unsmooth, it has a better transmission structure with higher versatility and more stable power transmission.

Figure 15:
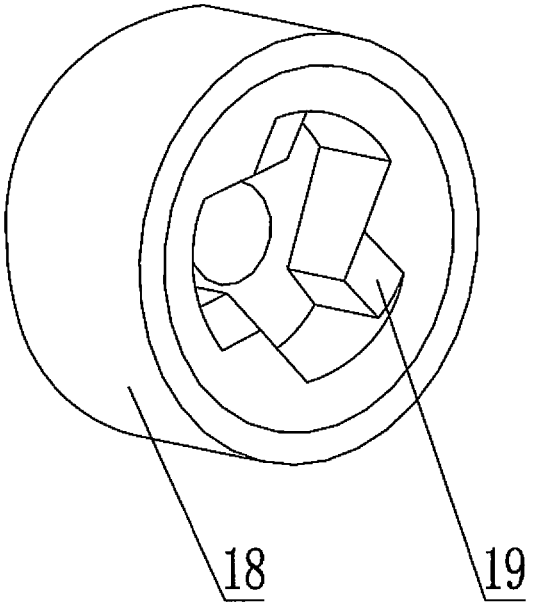
FIG. 15 is a schematic illustration of a concave connection head in the second embodiment of the present invention.

In the second embodiment, as shown in FIG. 15, the concave connection head 18 is provided with a Y-shaped slot to fit with the triangle output head 17, each of the three straight slots of the Y-shaped slot being provided with an inclined plane 19 at the same side. The inclined planes 19 of the second embodiment allows the triangle output head 17 to smoothly reach into the concave connection heads 18 for quick coupling.

Obviously, the embodiments of the present invention are merely for clearly describing the examples of the present invention, and not intended to limit the implementations of the present invention. For those skilled in the art, other changes or variations in different forms may be made on the basis of the foregoing descriptions. It is unnecessary and impossible to exhaustively list all implementations herein. These obvious changes or variations made within the essence and spirit of the present invention shall fall into the protection scope of the present invention.

The invention claimed is:

1. A multifunctional electric groomer comprising a casing in which a driving module is provided, the casing including a first end and a second end, the second end being opposite the first end, wherein the multifunctional electric groomer further comprises at least two blade sets, each of which is equipped with a support, a first end of the support fixing the blade set and a second end of the support being hinged on the casing via a hinge at a hinge point, with the hinge points of the supports successively arranged along a direction from the first end of the casing to the second end of the casing; and each of the blade sets has an operating position in which the blade set is dynamically coupled with the driving module and a housed position in which the blade set is housed inside the casing, and a clutch coupling positioned between an output of the driving module and an input of the blade set.

2. The multifunctional electric groomer according to claim 1, wherein the blade sets comprise a nose hair trimmer blade set, a hair clipper blade set and a shaver blade set, and a first support, a second support and a third support respectively connected to the nose hair trimmer blade set, the hair clipper blade set and the shaver blade set; and the groomer is configurable in a plurality of blade-set configurations, including a housed configuration where the nose hair trimmer blade set, the hair clipper blade set and the shaver blade set are all in their housed positions, a nose hair trimmer configuration where the nose hair trimmer blade set is in the operating position whereas the hair clipper blade set and the shaver blade set are in their housed positions, a hair clipper configuration where the hair clipper blade set is in the operating position whereas the nose hair trimmer blade set and the shaver blade set are in their housed positions, and a shaver configuration where the shaver blade set is in the operating position whereas the nose hair trimmer blade set and the hair clipper blade set are in their housed positions.

3. The multifunctional electric groomer according to claim 2, wherein end parts of input shafts of the nose hair trimmer blade set, the hair clipper blade set and the shaver blade set respectively follow semicircle turning tracks of a first track, a second track and a third track with a corresponding radius of (R1), (R2) and (R3); and the first track, the second track, and the third track are tangent to each other at an end part of an output shaft of the driving module, with (R1)<(R2)<(R3).

4. The multifunctional electric groomer according to claim 2, wherein the first support, the second support, and the third support are each two-armed supports and are hinged on two sides of the casing.

5. The multifunctional electric groomer according to claim 4, wherein respective distances between the two arms of the first support, the second support, and the third support get larger in sequence in the direction of the first end of the casing to the second end of the casing.

6. The multifunctional electric groomer according to claim 5, wherein a pile head is provided at a clearance between the driving module and the casing, and the first support, the second support, and the third support are hinged on the driving module, the pile head, and the casing respectively.

7. The multifunctional electric groomer according to claim 1, wherein the casing is box shaped, the driving module is positioned at a front half of the casing and has an output shaft facing outwards, and a rear half of the casing functions as a housing chamber of the blade sets.

8. The multifunctional electric groomer according to claim 7, wherein a receiving chamber for receiving the driving module is provided at a front half of the casing, and the casing and the receiving chamber are integrally formed.

9. The multifunctional electric groomer according to claim 7, wherein a flip cover is hinged on the casing, the flip cover having, when flipped open, a first position allowing switchover of the blade sets, and having, when closed, a second position for operation or storage.

10. The multifunctional electric groomer according to claim 9, wherein a notch is provided on the flip cover to expose a switch button of the driving module.

11. The multifunctional electric groomer according to claim 1, wherein the clutch coupling is a magnetic coupling comprising an active pole mounted on an output shaft of the driving module and passive poles on input shafts of the blade sets.

12. The multifunctional electric groomer according to claim 11, wherein the magnetic coupling is a planar synchronous transmission, and magnets with their north poles and south poles alternately arranged are provided on opposite disk planes of the active pole and the passive poles.

13. The multifunctional electric groomer according to claim 11, wherein an isolation layer that isolates the active pole from outside is provided on the casing.

14. The multifunctional electric groomer according to claim 1, further comprising a clutch coupling that comprises a triangle output head mounted on an output shaft of the driving module, and concave connection heads mounted on input shafts of the blade sets; and the triangle output head is retractable, and has, when compressed, a first position allowing switchover of the blade sets and has, when protruding into the concave connection heads, a second position for power transmission.

15. The multifunctional electric groomer according to claim 14, wherein the concave connection head is provided with a Y-shaped slot to fit with the triangle output head, each of the three straight slots of the Y-shaped slot being provided with an inclined plane at the same side.

16. The multifunctional electric groomer according to claim 3, wherein the first support, the second support, and the third support are each two-armed supports and are hinged on two sides of the casing.

17. The multifunctional electric groomer according to claim 2, wherein the casing is box shaped, the driving module is positioned at a front half of the casing and has an output shaft facing outwards, and a rear half of the casing functions as a housing chamber of the blade sets.

18. The multifunctional electric groomer according to claim 3, wherein the casing is box shaped, the driving module is positioned at a front half of the casing and has an output shaft facing outwards, and a rear half of the casing functions as a housing chamber of the blade sets.

19. The multifunctional electric groomer according to claim 12, wherein an isolation layer that isolates the active pole from outside is provided on the casing.

* * * * *